US010487477B2

(12) United States Patent
Yun et al.

(10) Patent No.: US 10,487,477 B2
(45) Date of Patent: Nov. 26, 2019

(54) APPARATUS AND METHOD FOR CONTROLLING CONSTRUCTION MACHINE

(71) Applicant: DOOSAN INFRACORE CO., LTD., Incheon (KR)

(72) Inventors: Hong Cheol Yun, Guri-si (KR); Byoung Heon Park, Incheon (KR)

(73) Assignee: DOOSAN INFRACORE CO., LTD., Incheon (KR)

( * ) Notice: Subject to any disclaimer, the term of this patent is extended or adjusted under 35 U.S.C. 154(b) by 0 days.

(21) Appl. No.: 15/741,645

(22) PCT Filed: Jul. 1, 2016

(86) PCT No.: PCT/KR2016/007121
§ 371 (c)(1),
(2) Date: Jan. 3, 2018

(87) PCT Pub. No.: WO2017/007185
PCT Pub. Date: Jan. 12, 2017

(65) Prior Publication Data

US 2018/0195254 A1 Jul. 12, 2018

(30) Foreign Application Priority Data

Jul. 3, 2015 (KR) ..... 10-2015-0095147

(51) Int. Cl.
*F02D 35/00* (2006.01)
*E02F 9/22* (2006.01)
(Continued)

(52) U.S. Cl.
CPC ..... *E02F 9/2246* (2013.01); *E02F 3/43* (2013.01); *E02F 9/2004* (2013.01);
(Continued)

(58) Field of Classification Search
CPC ..... E02F 9/2246; E02F 3/43
See application file for complete search history.

(56) References Cited

U.S. PATENT DOCUMENTS

2010/0185336 A1* 7/2010 Rovnyak ..... H02J 3/38 700/287
2011/0071738 A1 3/2011 Kawasaki et al.
(Continued)

FOREIGN PATENT DOCUMENTS

EP 2284322 A2 2/2011
EP 2705967 A2 3/2014
(Continued)

OTHER PUBLICATIONS

International Search Report dated Oct. 11, 2016 corresponding to International Application No. PCT/KR2016/007121.
(Continued)

*Primary Examiner* — Jess Whittington
(74) *Attorney, Agent, or Firm* — Hauptman Ham, LLP

(57) ABSTRACT

The present invention relates to an apparatus and method for controlling a construction machine. An apparatus for controlling a construction machine according to an embodiment of the present invention may compare a fuel efficiency gain expected when engine revolutions per minute (RPM) is decreased with a fuel efficiency gain expected when a current torque curve is changed to a torque curve corresponding to a condition in which auxiliary power is provided and selected from among the plurality of torque curves and then the latter torque curve is selectively applied, based on the fuel efficiency map, and may control an engine by means of a method by which a larger fuel efficiency gain is expected.

6 Claims, 4 Drawing Sheets

(51) Int. Cl.

| | |
|---|---|
| ***E02F 3/43*** | (2006.01) |
| ***E02F 9/20*** | (2006.01) |
| ***F04B 49/00*** | (2006.01) |
| ***F15B 21/08*** | (2006.01) |
| ***F15B 21/14*** | (2006.01) |
| ***F03C 1/00*** | (2006.01) |
| *F02D 29/04* | (2006.01) |

(52) U.S. Cl.

CPC ..... *E02F 9/2066* (2013.01); *E02F 9/2075* (2013.01); *E02F 9/2228* (2013.01); *E02F 9/2285* (2013.01); *F02D 35/00* (2013.01); *F02D 35/0007* (2013.01); *F03C 1/00* (2013.01); *F04B 49/002* (2013.01); *F15B 21/087* (2013.01); *F15B 21/14* (2013.01); *F02D 29/04* (2013.01); *F15B 2211/20523* (2013.01); *F15B 2211/20569* (2013.01); *F15B 2211/20576* (2013.01); *F15B 2211/212* (2013.01); *F15B 2211/3144* (2013.01); *F15B 2211/327* (2013.01); *F15B 2211/6346* (2013.01); *F15B 2211/6651* (2013.01)

(56) References Cited

U.S. PATENT DOCUMENTS

| | | | | |
|---|---|---|---|---|
| 2012/0072065 | A1* | 3/2012 | Minamikawa | B60K 6/445 701/22 |
| 2013/0006457 | A1 | 1/2013 | Anders et al. | |
| 2013/0090835 | A1 | 4/2013 | Take et al. | |
| 2013/0289810 | A1* | 10/2013 | Holmes | B60K 6/24 701/22 |
| 2014/0054902 | A1 | 2/2014 | Kawaguchi et al. | |
| 2014/0156099 | A1* | 6/2014 | Ayana | H02M 7/219 700/297 |
| 2014/0371915 | A1* | 12/2014 | Ishihara | B60K 6/485 700/275 |
| 2016/0052508 | A1* | 2/2016 | Teraya | F01N 3/20 701/22 |
| 2016/0340871 | A1* | 11/2016 | Ohkubo | B60W 10/06 |
| 2017/0129473 | A1* | 5/2017 | Zhang | B60W 20/11 |

FOREIGN PATENT DOCUMENTS

| | | | |
|---|---|---|---|
| JP | 2004-150305 | A | 5/2004 |
| KR | 10-2008-0049519 | A | 6/2008 |
| KR | 10-2011-0012037 | A | 2/2011 |
| KR | 10-2012-0139768 | A | 12/2012 |
| KR | 10-2014-0109407 | A | 9/2014 |

OTHER PUBLICATIONS

The extended European search report dated Jan. 10, 2019 for corresponding European Application No. 16821591.1.

* cited by examiner

APPARATUS AND METHOD FOR CONTROLLING CONSTRUCTION MACHINE

CROSS REFERENCE TO RELATED APPLICATION

This application claims the priority of Korean Patent Application No. 10-2015-0095147 filed on Jul. 3, 2015, in the Korean Intellectual Property Office, the disclosure of which is incorporated herein by reference. Further, this application is the National Phase application of International Application No. PCT/KR2016/007121 filed Jul. 1, 2016, which designates the United States.

TECHNICAL FIELD

The present invention relates to an apparatus and method for controlling a construction machine, and more specifically to an apparatus and method for controlling a construction machine, which is capable of controlling an engine at optimum fuel efficiency when an auxiliary power device is added to the construction machine.

BACKGROUND ART

Generally, attempts to improve the fuel efficiency of construction machines have been made.

Furthermore, a construction machine is equipped with an energy storage device, and auxiliary power is implemented using energy stored in the energy storage device. The auxiliary power enables the load of an engine to be reduced.

Meanwhile, each engine has different dynamic characteristics. In particular, the optimum fuel efficiency of such an engine may vary depending on specific engine revolutions per minute (RPM).

However, according to a conventional technology, although in a conventional construction machine, a load imposed on an engine can be reduced by auxiliary power and thus engine RPM can be changed, the conventional construction machine is problematic in that it cannot implement optimum fuel efficiency corresponding to the changed engine RPM.

DISCLOSURE

Technical Problem

Embodiments of the present invention provide an apparatus and method for controlling a construction machine, which is capable of implementing optimum fuel efficiency in response to engine RPM which is implemented when an auxiliary power device is added to the construction machine and then auxiliary power is provided by the auxiliary power device.

Technical Solution

According to an embodiment of the present invention, there is provided an apparatus for controlling a construction machine, the apparatus including: an electronic joystick configured to generate a request signal; a main controller configured to receive the request signal and generate a torque command and a pilot signal; an engine control unit configured to receive the torque command and generate an engine revolutions per minute (RPM) command; an engine configured to operate in compliance with the engine RPM command; a hydraulic pump/motor configured to be operated by the engine and discharge a working fluid or to be driven by an incoming working fluid and output power; a main control valve controller configured to receive the pilot signal and control an electronic proportional control valve configured to control the working device; and an auxiliary power device configured to be additionally installed on the engine or hydraulic pump/motor and provide auxiliary power to the engine or hydraulic pump/motor. A fuel efficiency map is installed on the main controller or engine control unit. The fuel efficiency map includes a plurality of torque curves for engine RPMs and fuel efficiency curves for engine RPMs which are set according to various conditions. When the auxiliary power is provided by the auxiliary power device, the main controller or engine control unit decreases the engine RPM, or changes a current torque curve to a torque curve corresponding to a condition in which the auxiliary power is provided and selected from among the plurality of torque curves and selectively applies the latter torque curve, based on the fuel efficiency map.

When the auxiliary power is provided and thus the engine RPM is decreased, the engine RPM may be decreased by a difference between an engine RPM value based on the engine RPM command and a current engine RPM value.

The main controller or engine control unit may compare a fuel efficiency gain expected when the engine RPM is decreased with a fuel efficiency gain expected when the current torque curve is changed to the torque curve corresponding to the condition in which the auxiliary power is provided and selected from among the plurality of torque curves and the latter torque curve is selectively applied based on the fuel efficiency map, and may control the engine by means of a method by which a larger fuel efficiency gain is expected.

Additionally, according to an embodiment of the present invention, there is provided a method of controlling a construction machine, which controls an engine by means of a fuel efficiency map including a plurality of torque curves for engine RPMs and fuel efficiency curves for engine RPMs which are set according to various conditions, the method including: determining whether auxiliary power is provided; when the auxiliary power is provided, calculating a fuel efficiency gain expected when the engine RPM is decreased based on the fuel efficiency map; when the auxiliary power is provided, calculating a fuel efficiency gain expected when a current torque is changed to a torque curve corresponding to a condition in which the auxiliary power is provided and selected from among the plurality of torque curves and then the latter torque curve is selectively applied based on the fuel efficiency map; and, when the auxiliary power is provided, comparing the fuel efficiency gain expected when the engine RPM is decreased with the fuel efficiency gain expected when the torque curve is changed, and controlling the engine by means of a method by which a larger fuel efficiency gain is expected.

When the auxiliary power is provided and thus the engine RPM is decreased, the engine RPM may be decreased by a difference between an engine RPM value based on an engine RPM command and a current engine RPM value.

Advantageous Effects

According to the embodiments of the present invention, when auxiliary power is provided by the auxiliary power device and engine RPM is changed, the apparatus and method for controlling a construction machine can decrease the engine RPM or change a torque curve, thereby implementing optimum fuel efficiency corresponding to the changed engine RPM.

MODE FOR INVENTION

The advantages and features of the present invention and methods for implementing the advantages and the features will be apparent from embodiments that will be described in detail below in conjunction with the accompanying drawings.

The embodiments of the present invention will be described in detail below with reference to the accompanying drawings. The embodiments which will be described below are provided as examples to help to understand the present invention. It should be understood that the present invention may be practiced in variously modified forms different from the embodiment described therein. Furthermore, in the description of the present invention, when it is determined that a detailed description of a related well-known function or component may unnecessarily make the gist of the present invention obscure, it will be omitted. Furthermore, in order to help to understand the present invention, the accompanying drawings may not be illustrated according to actual scale, but may be exaggeratedly illustrated.

Meanwhile, technical terms to be described later are terms set by taking into account their functions in the present invention, and may vary according to the intention of a manufacturer or practice. Accordingly, the terms should be defined based on the content of the overall specification.

Throughout the specification, the same reference symbols denote the same components.

Figure 1:
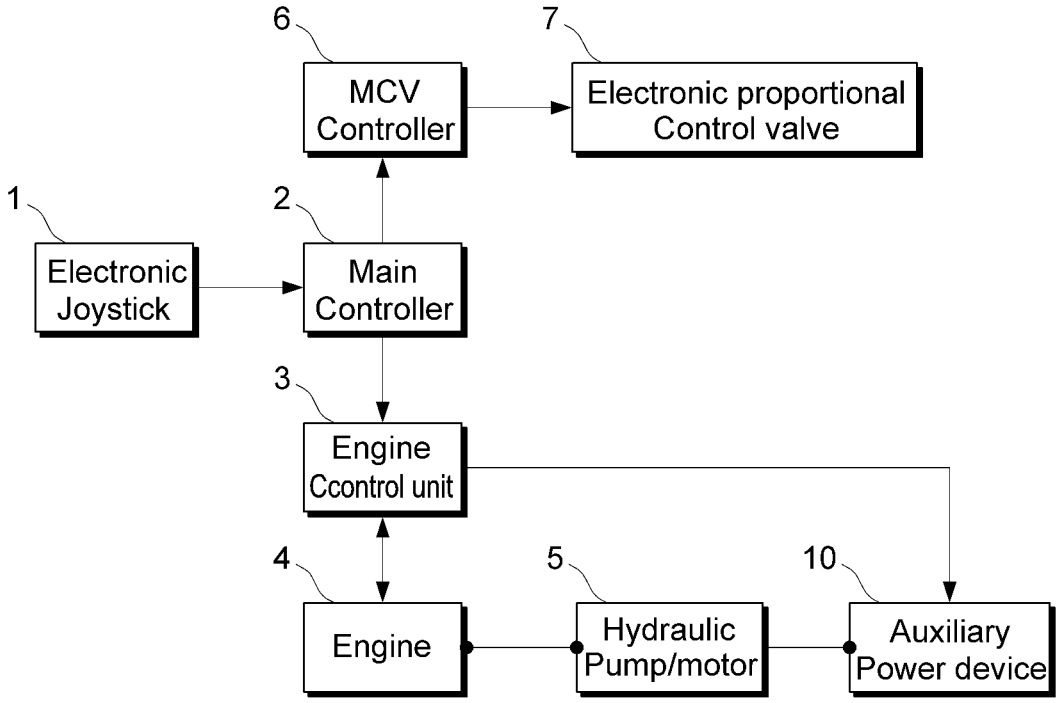
FIG. 1 is a diagram illustrating an apparatus and method for controlling a construction machine according to embodiments of the present invention.
Figure 2:
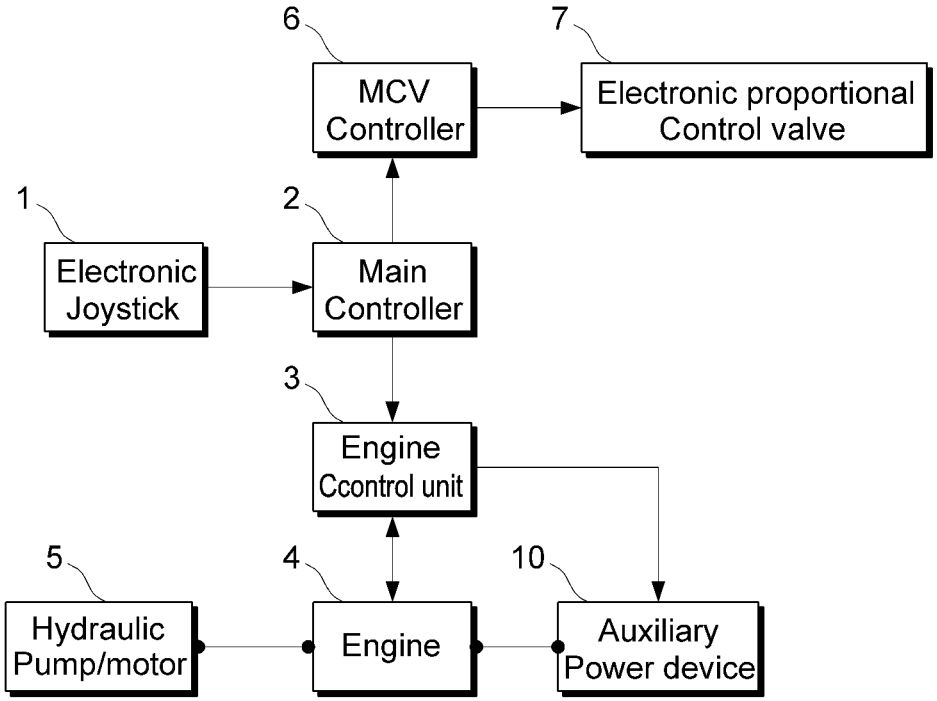
FIG. 2 is a diagram illustrating an apparatus and method for controlling a construction machine according to other embodiments of the present invention.
Figure 3:
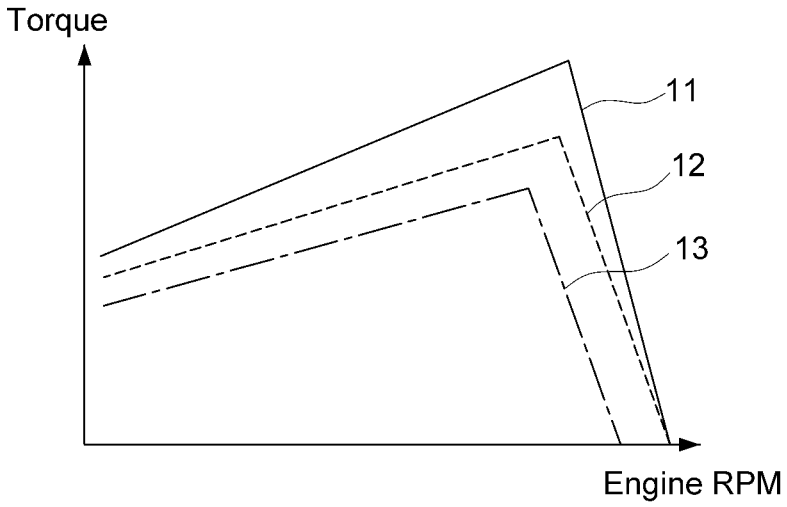
FIG. 3 is a graph illustrating an example of torque curves for engine RPMs in a fuel efficiency map in an apparatus and method for controlling a construction machine according to embodiments of the present invention.
Figure 4:
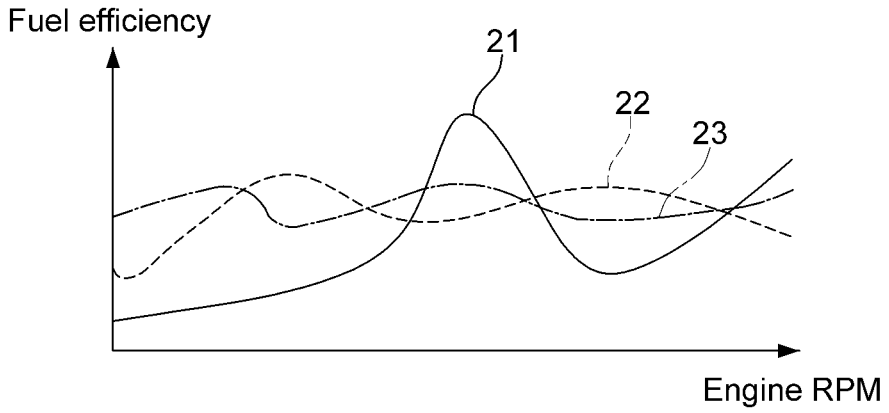
FIG. 4 is a graph illustrating an example of fuel efficiency curves for engine RPMs in a fuel efficiency map in an apparatus and method for controlling a construction machine according to embodiments of the present invention.

Apparatuses and methods for controlling a construction machine according to embodiments of the present invention will be described below with reference to FIGS. 1 to 4. The accompanying FIG. 1 is a diagram illustrating an apparatus and method for controlling a construction machine according to embodiments of the present invention. FIG. 2 is a diagram illustrating an apparatus and method for controlling a construction machine according to other embodiments of the present invention. FIG. 3 is a graph illustrating an example of torque curves for engine RPMs in a fuel efficiency map in an apparatus and method for controlling a construction machine according to embodiments of the present invention. FIG. 4 is a graph illustrating an example of fuel efficiency curves for engine RPMs in a fuel efficiency map in an apparatus and method for controlling a construction machine according to embodiments of the present invention.

Embodiment 1

An apparatus for controlling a construction machine according to an embodiment of the present invention may include an electronic joystick 1, a main controller 2, an engine control unit 3, an engine 4, a hydraulic pump/motor 5, a main control valve controller 6, and an auxiliary power device 10.

The electronic joystick 1 generates a request signal. In greater detail, an operator manipulates the electronic joystick 1 in order to operate a specific working device according to his or her intention. In this case, the electronic joystick 1 generates a request signal adapted to control the corresponding working device.

For example, when the corresponding construction machine is an excavator, the working device may include a boom cylinder configured to operate a boom, an atm cylinder configured to operate an aim, a bucket cylinder configured to operate a bucket, and an optional device in the case where the optional device is connected.

On the other hand, the above-described request signal may be a signal adapted to rotate an upper rotating structure, or may be a signal adapted to enable the construction machine to travel.

The main controller 2 receives the request signal, and generates a torque command and a pilot signal. The torque command may be a signal adapted to control the output of the engine 4 or the output of the hydraulic pump/motor. The pilot signal may be a signal adapted to control any one of the above-described various working devices.

Meanwhile, the above-described main controller 2 may be a vehicle control unit (VCU).

The engine control unit 3 receives the torque command, and generates an engine RPM command. In other words, the engine control unit 3 is a device configured to control the engine 4.

The engine 4 implements corresponding engine RPM in compliance with the engine RPM command. In other words, the engine 4 outputs power in order to implement the requested torque command.

The hydraulic pump/motor 5 may be operated by the engine 4, and may discharge a working fluid. Furthermore, the hydraulic pump/motor 5 may be driven by an incoming working fluid, and may output power. In other words, the hydraulic pump/motor 5 may be used as a hydraulic pump when discharging a working fluid, while the hydraulic pump/motor 5 may be used as a hydraulic motor when being driven by the pressure of a working fluid.

Meanwhile, when the hydraulic pump/motor 5 is used as a hydraulic motor, it may generate electricity by operating an alternator, and the generated electrical energy may be stored in an energy storage device.

The main control valve controller 6 receives the pilot signal, and controls an electronic proportional control valve 7 configured to control a corresponding working device.

In greater detail, each working device may include the electronic proportional control valve 7 in order to change the flow rate and direction of the working fluid. For example, when the above-described pilot signal is a pilot signal adapted to lift a boom, the electronic proportional control valve 7 configured to supply a working fluid to a boom actuator is operated, and thus the working fluid is provided to the boom actuator in a direction which lifts the boom.

In other words, the main control valve controller 6 may be provided with an electronic proportional control valve 7 configured to control each working device.

The auxiliary power device 10 is additionally installed on the engine 4 or hydraulic pump/motor 5, and provides auxiliary power to the engine 4 or hydraulic pump/motor 5.

In an exemplary embodiment as shown in FIG. 1, in case the auxiliary power device 10 may be added to be connected to the hydraulic pump/motor 5 for power transmission, the auxiliary power device 10 may provide an auxiliary power to the hydraulic pump/motor 5. Furthermore, the auxiliary power device 10 may be driven by the pressure of a working fluid stored in an accumulator. Accordingly, the auxiliary power device 10 assists the hydraulic pump/motor 5 in operating, thus resulting in a reduction in a load which is imposed on the engine 4.

Furthermore, as shown in FIG. 2, the auxiliary power device 10 may be additionally installed on the engine 4. In this case, the auxiliary power device 10 may be an electric motor. The electric motor may receive electrical energy from the energy storage device, and may be then driven.

The energy storage device may be a device configured to store electrical energy generated using a working fluid discharged from a boom cylinder when a boom is lowered by its own weight, or may be a device configured to store electrical energy generated using a working fluid discharged when the upper rotating structure is rotated by inertia. In this case, generation may be performed using a hydraulic motor and an alternator.

Furthermore, a fuel efficiency map may be installed on the main controller 2 or engine control unit 3. The fuel efficiency map may include a plurality of torque curves for engine RPMs, such as that shown in FIG. 3, and fuel efficiency curves for engine RPMs, such as that shown in FIG. 4, which are set according to various conditions. In this case, the plurality of torque curves includes torque curves corresponding to conditions in which the auxiliary power device 10 to be described later provides auxiliary power.

The torque curves for engine RPMs may be differently provided according to each engine. In other words, as shown in FIG. 3, a number of torque curves (see 11, 12, and 13) may be provided. The torque curves for engine RPMs are prepared by the manufacturer of the engine or construction machine by testing corresponding equipment and deriving the increase and decrease characteristics of torque for the engine RPMs.

The reason why the number of torque curves (see 11, 12, and 13) are obtained is that although the same engine manufacturer manufactures engines of the same model, dynamic characteristics may vary depending on each engine.

In the same manner, the fuel efficiency curves for engine RPMs may be differently provided according to each engine. In other words, as shown in FIG. 4, a number of fuel efficiency curves (see 21, 22, and 23) may be provided. The fuel efficiency curves for engine RPMs are prepared by the manufacturer of the engine or construction machine by testing corresponding equipment and deriving the increase and decrease characteristics of fuel efficiency for the engine RPMs.

The reason why the number of fuel efficiency curves (see 21, 22, and 23) are obtained is that although the same engine manufacturer manufactures engines of the same model, dynamic characteristics may vary depending on each engine.

When the engine 4 is provided with auxiliary power by the auxiliary power device 10, a load may be reduced, and thus engine RPM may be increased. In other words, a margin for a reduction in the engine RPM is generated.

Furthermore, when the hydraulic pump/motor 5 is provided with auxiliary power by the auxiliary power device 10, a load may be decreased, and thus the torque of the hydraulic pump/motor may be increased. In other words, a margin for an increase in the torque of the hydraulic pump/motor is generated.

Accordingly, in the apparatus for controlling a construction machine according to the embodiment of the present invention, when auxiliary power is provided by the auxiliary power device 10, the main controller 2 or engine control unit 3 may decrease the engine RPM or may change a current torque curve to and selectively apply a torque curve corresponding to a condition in which the auxiliary power is provided and selected from among the plurality of torque curves based on the fuel efficiency map, thereby performing control such that optimum fuel efficiency can be implemented.

Furthermore, the apparatus for controlling a construction machine according to the embodiment of the present invention may obtain total torque by summing the current maximum output torque of the engine 4 and auxiliary torque provided by the auxiliary power device 10.

Furthermore, the torque curve to which the current torque curve is changed by the main controller 2 or engine control unit 3 may be a torque curve which is appropriately selected from among the plurality of torque curves such that currently required torque can become equal to the total torque.

This enables the main controller 2 or engine control unit 3 to change a torque curve such that redundant torque is not generated. When the torque curve is changed, a reduction of about 1 to 5% in fuel efficiency is possible, although it varies depending on each interval of engine RPMs.

In other words, the apparatus for controlling a construction machine according to the embodiment of the present invention may further change a torque curve such that the most optimal torque curve can be selected from among the number of previously installed torque curves in order to implement optimum fuel efficiency, thereby implementing an increase in fuel efficiency.

Furthermore, the apparatus for controlling a construction machine according to the embodiment of the present invention may decrease engine RPM by a difference between the engine RPM value of the engine RPM command and a current engine RPM value when auxiliary power is provided and thus a decrease in engine RPM is desired.

As described in conjunction with embodiment 1, the engine 4 or hydraulic pump/motor 5 may be provided with auxiliary power by the auxiliary power device 10, and thus engine RPM may be increased.

Generally, when a reduction of 100 rpm is made in a high-speed interval in which engine RPM ranges from 1700 to 2000 rpm, a fuel efficiency increase effect of about 2 to 3% is obtained. Furthermore, a fuel efficiency increase effect of about 1 to 2% is obtained even in an engine RPM interval lower than the high-speed interval.

As a result, the apparatus for controlling a construction machine according to the embodiment of the present invention may decrease engine RPM by performing control such that the engine RPM value of the engine RPM command can become equal to actual engine RPM, and fuel efficiency is improved to the extent that the engine RPM is decreased.

Embodiment 2

An apparatus for controlling a construction machine according to an embodiment of the present invention may perform control such that a torque curve or engine RPM can be changed by the main controller 2 or engine control unit 3.

More specifically, the main controller 2 or engine control unit 3 compares a fuel efficiency gain expected when engine RPM is decreased with a fuel efficiency gain expected when a current torque is changed to a torque curve corresponding to a condition in which auxiliary power is provided and selected from among the plurality of torque curves and then the torque curve is selectively applied based on the fuel efficiency map, and controls the engine 4 by means of a method by which a larger fuel efficiency gain is expected.

Again, a description is given using an example. Total torque is obtained by summing the current maximum output torque of the engine 4 and auxiliary torque provided by the auxiliary power device 10, and there is obtained a first fuel efficiency gain expected when a torque curve is changed such that currently required torque can become equal to the total torque.

Furthermore, there is obtained a second fuel efficiency gain expected when an engine RPM command is changed by decreasing engine RPM by a difference between the engine RPM value of the engine RPM command and a current actual engine RPM value.

Furthermore, the first fuel efficiency gain and the second fuel efficiency gain are compared with each other, and control is performed such that the torque curve is changed when the first fuel efficiency gain is preferable to the second fuel efficiency gain and such that the engine RPM is decreased when the second fuel efficiency gain is preferable to the first fuel efficiency gain.

As a result, although the apparatus for controlling a construction machine according to the embodiment of the present invention may perform control such that a torque curve or engine RPM is changed, control may be performed in a condition which is more preferable for an increase in fuel efficiency, thereby controlling the construction machine in an optimum fuel efficiency condition.

Embodiment 3

A method of controlling a construction machine according to an embodiment of the present invention will be described below.

The method of controlling a construction machine may control the engine 4 by means of a fuel efficiency map including a plurality of torque curves for engine RPMs and fuel efficiency curves for engine RPMs which are set according to various conditions.

First, it is determined whether the auxiliary power device 10 provides auxiliary power.

Furthermore, when auxiliary power is provided, there is calculated a fuel efficiency gain expected when the engine RPM is decreased based on the fuel efficiency map.

Moreover, when auxiliary power is provided, there is calculated a fuel efficiency gain expected when a current torque curve is changed to a torque curve corresponding to a condition in which the auxiliary power is provided and selected from among the plurality of torque curves and the torque curve is selectively applied.

Thereafter, when auxiliary power is provided, the fuel efficiency gain expected when the engine RPM is decreased is compared with the fuel efficiency gain expected when the torque curve is changed, and the engine 4 is controlled by means of a method by which a larger fuel efficiency gain is expected.

In this case, when auxiliary power is provided and thus the engine RPM is decreased, the engine RPM may be decreased by a difference between an engine RPM value based on an engine RPM command transferred to the engine 4 and a current engine RPM value.

Again, a description is given using an example. In accordance with the method of controlling a construction machine according to the embodiment of the present invention, there is obtained fuel efficiency expected when auxiliary power is provided.

First, the engine 4 or hydraulic pump/motor 5 is provided with auxiliary power by the auxiliary power device 10.

In this case, total torque is obtained by summing the current maximum output torque of the engine 4 and auxiliary torque provided by the auxiliary power device 10.

Furthermore, there is obtained a first fuel efficiency gain expected when a torque curve is changed such that currently required torque can become equal to the total torque.

Moreover, there is obtained a second fuel efficiency gain expected when the engine RPM command is changed by decreasing the engine RPM by a difference between the engine RPM value of the engine RPM command and a current actual engine RPM value.

Thereafter, there is performed a comparison step of comparing the first fuel efficiency gain and the second fuel efficiency gain with each other.

When the first fuel efficiency gain is preferable to the second fuel efficiency gain at the comparison step, control is performed such that the torque curve is changed.

In contrast, when the second fuel efficiency gain is preferable to the first fuel efficiency gain at the comparison step, control is performed such that the engine RPM is decreased.

As a result, although the method of controlling a construction machine according to the embodiment of the present invention may perform control such that a torque curve or engine RPM is changed, control may be performed in a condition which is more preferable for an increase in fuel efficiency, thereby controlling the construction machine in an optimum fuel efficiency condition.

As described above, when auxiliary power is provided by the auxiliary power device 10 and thus engine RPM is changed, the apparatus and method for controlling a construction machine according to the embodiments of the present invention may decrease the engine RPM or change a torque curve, thereby implementing optimum fuel efficiency corresponding to the changed engine RPM.

Although the embodiments of the present invention have been described with reference to the accompanying drawings, it will be understood by a person skilled in the art to which the present invention pertains that the present invention may be practiced in a different specific form without changing technical spirit or an essential feature.

Therefore, it should be understood that the above-described embodiments are illustrative but not restrictive in all aspects. The scope of the present invention is defined based on the attached claims. All modifications or alterations derived from the meanings and scope of the claims and concepts equivalent to the claims should be construed as being included in the scope of the present invention.

INDUSTRIAL APPLICABILITY

The apparatus and method for controlling a construction machine according to the embodiments of the present invention may be used to optimally implement fuel efficiency when an auxiliary power device is added to an engine or hydraulic pump/motor and then auxiliary power is provided by the auxiliary power device.

The invention claimed is:

1. An apparatus for controlling a construction machine, the apparatus comprising:

a joystick configured to generate a request signal;

a main controller configured to receive the request signal and generate a torque command and a pilot signal;

an engine control unit configured to receive the torque command and generate an engine revolutions per minute (RPM) command;

an engine configured to operate in compliance with the engine RPM command;

a hydraulic pump/motor configured to be operated by the engine and discharge a working fluid or to be driven by an incoming working fluid and output power; and an auxiliary power device, additionally installed on the engine or the hydraulic pump/motor, configured to provide auxiliary power to the engine or the hydraulic pump/motor;

wherein a fuel efficiency map is installed on the main controller or engine control unit;

wherein the fuel efficiency map includes a plurality of torque curves representing the change in torque as engine RPM changes and a plurality of fuel efficiency curves representing changes in fuel economy as engine RPM changes; and wherein the main controller or engine control unit compares a first fuel efficiency gain expected when the engine RPM is decreased with a second fuel efficiency gain expected when a current torque curve is changed to a torque curve corresponding to a condition in which the auxiliary power is provided and selected from among the plurality of torque curves and then the latter torque curve is selectively applied, based on the fuel efficiency map, and controls the engine by means of a method by which a larger fuel efficiency gain is expected.

2. The apparatus of claim 1, wherein when the auxiliary power is provided and the engine RPM is decreased, the engine RPM is decreased by a difference between an engine RPM value based on the engine RPM command and a current engine RPM value.

3. The apparatus of claim 1, wherein the auxiliary power device has a hydraulic pump/motor which is driven by the pressure of a working fluid stored in an accumulator, the accumulator is configured to store the working fluid discharged from a boom actuator when a boom is lowered by its own weight, or to store the working fluid discharged when an upper rotating structure is turned by inertia.

4. The apparatus of claim 1, wherein the auxiliary power device has an electric motor which is received electrical energy from an energy storage device, the energy storage device is configured to store electric energy generated by working fluid discharged from a boom actuator when a boom is lowered by its own weight, or to store electric energy generated by working fluid discharged when an upper rotating structure is turned by inertia.

5. A method of controlling a construction machine, which controls an engine by means of a fuel efficiency map including a plurality of torque curves representing the change in torque as engine RPM changes and a plurality of fuel efficiency curves representing changes in fuel economy as engine RPM changes, the method comprising:

determining whether auxiliary power is provided;

when the auxiliary power is provided, calculating a first fuel efficiency gain expected when the engine RPM is decreased according to the fuel efficiency curve under a condition that the auxiliary power is provided;

when the auxiliary power is provided, calculating a second fuel efficiency gain expected when a current torque is changed to a torque curve corresponding to a condition in which the auxiliary power is provided among the plurality of torque curves; and when the auxiliary power is provided, comparing the first fuel efficiency gain expected when the engine RPM is decreased with the second fuel efficiency gain expected when the current torque curve is changed, and controlling the engine by means of a method by which a larger fuel efficiency gain is expected.

6. The method of claim 5, wherein when the auxiliary power is provided and the engine RPM is decreased, the engine RPM is decreased by a difference between an engine RPM value based on an engine RPM command and a current engine RPM value.

* * * * *